United States Patent [19]

Hayner

[11] Patent Number: 4,719,942

[45] Date of Patent: Jan. 19, 1988

[54] HYDRAULIC VALVE ASSEMBLY

[75] Inventor: Paul F. Hayner, Exeter, N.H.

[73] Assignee: Illinois Tool Works Inc., Chicago, Ill.

[21] Appl. No.: 50,522

[22] Filed: May 18, 1987

[51] Int. Cl.[4] ..... F15B 13/043

[52] U.S. Cl. ..... 137/625.61; 137/82; 137/625.3; 137/625.63; 137/625.64

[58] Field of Search ..... 137/82, 625.3, 625.61, 137/625.62, 625.63, 625.64

[56] References Cited

U.S. PATENT DOCUMENTS

| | | | |
|---|---|---|---|
| Re. 29,714 | 8/1978 | Hayner et al. | 137/625.3 X |
| 2,823,689 | 2/1958 | Healy | 137/625.64 X |
| 3,033,232 | 5/1962 | Bahniuk | 137/625.62 |
| 3,150,442 | 9/1964 | Straw et al. | 137/82 X |
| 3,943,957 | 3/1976 | Hayner | 137/625.64 X |
| 4,050,476 | 9/1977 | Hayner et al. | 137/625.62 |

*Primary Examiner*—Gerald A. Michalsky

*Attorney, Agent, or Firm*—D. J. Breh; T. W. Buckman

[57] ABSTRACT

An improved hydraulic valve assembly comprising a directional valve, such as a spool valve, and a pilot valve of a unique design. The pilot valve comprises a rocker arm, which is controlled by motor means imparting a torque on the rocker arm so as to move a pair of flappers toward and away from associated nozzles controlling pilot pressure to opposite ends of the directional valve. When one of a pair of transducers senses the pressure of hydraulic fluid returning from the directional valve, an opposing torque is imparted to the rocker arm. Equilibrium is achieved when the torques balance each other. The nozzles are provided with annular buffers preventing the nozzles and the flappers from being pressed against each other. The directional valve employs flow restrictors of a unique design wherein annular plates, in a stack, are provided with integral, arcuate, spaced baffles. The baffles, which are equal in angular width, are interdigited so as to provide serpentine paths for hydraulic fluid flowing radially through such restrictors.

12 Claims, 8 Drawing Figures

FIG. 2
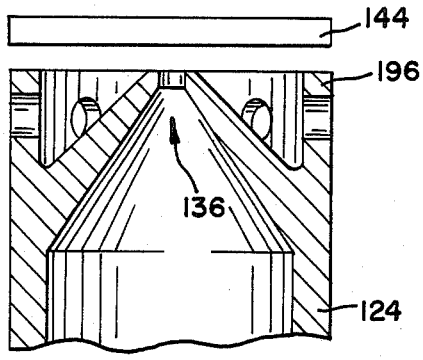
FIG. 4
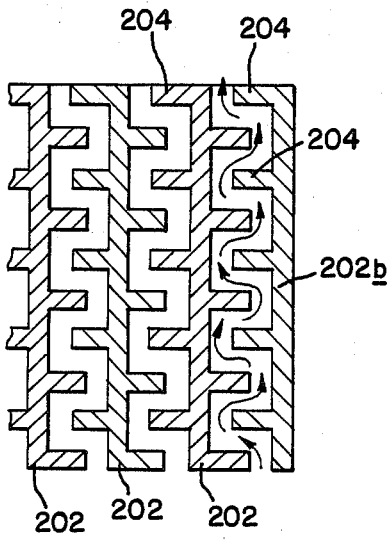
FIG. 3
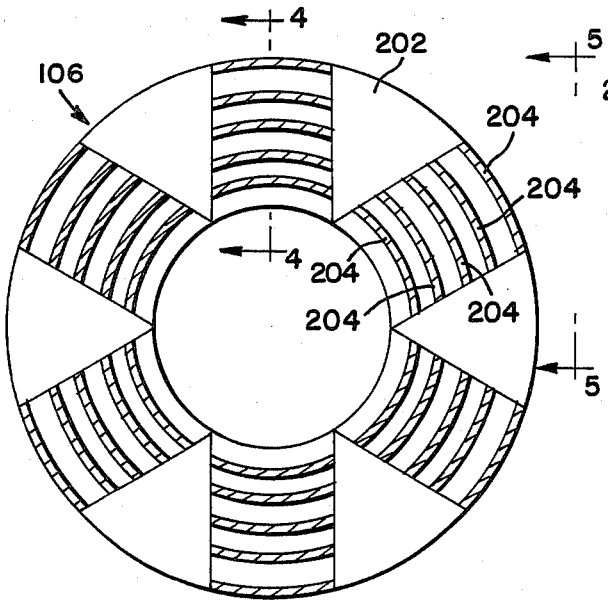
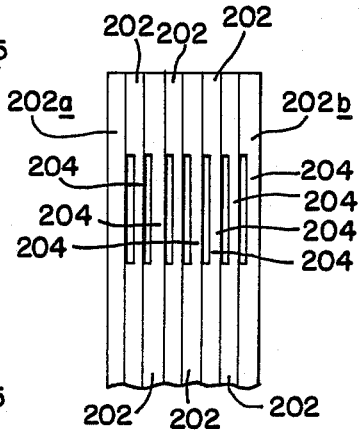
FIG. 5

HYDRAULIC VALVE ASSEMBLY

BACKGROUND OF THE INVENTION

This invention pertains generally to an improved, sero-controlled, hydraulic valve assembly and particularly to a valve assembly of a type comprising a directional valve, such as a spool valve, and a pilot valve controlling the directional valve. This invention pertains additionally to a valve structure for use in the pilot valve and to a flow restrictor for use in the directional valve.

An examwple of a valve assembly of the type noted above, wherein a directional, four-way, spool valve is controlled by a pilot valve, is disclosed in U.S. Pat. No. 3,943,957. The spool valve is a closed center valve in one embodiment and an open center valve in another embodiment. Another example is disclosed in U.S. Pat. No. 4,050,476, in which the spool valve is a closed center valve, and which also discloses an example of a known type of flow restrictor for use in such an assembly. The same type of slow restrictor is further disclosed in U.S. Pat. Re. 29,714, originally U.S. Pat. No. 3,688,800.

Prior valve assemblies in which such a directional valve is controlled by a pilot valve have a number of shortcomings, most of which are attributable to the pilot valve. Prior pilot valves employing feedback pressures (see, for examwple, U.S. Pat. No. 3,943,957) tend to react erroneously to feedback pressures which are due to leakage of hydraulic fluid in the directional valve or to hysteresis in the motor used to operate the pilot valve. Furthermore, such pilot valves tend to be highly sensitive to any temperature or viscosity changes in hydraulic fluid. Consequently, in a valve assembly employing such a pilot valve to control a directional valve, the directional valve tends undesirably to drift out of its center or null condition.

SUMMARY OF THE INVENTION

It is a principal object of this invention to provide an improved, servo-controlled, hydraulic valve assembly, in which a directional valve, such a spool valve, is hydraulically positioned by means of a pilot valve of a unique design.

The valve assembly is universal in a sense that the valve assembly can be readily adapted, as by replacement of a few parts with similar parts having different operating characteristics, for operating within a wide range of primary pressures of hydraulic fluid. The valve assembly is servo-controlled in a sense that the directional valve, which operates at primary pressure, is controlled by the pilot valve, which operates at pilot pressure. Typically, pilot pressure is substantially lower than primary pressure, even if a single pump is used.

More particularly, the directional valve has a pair of inlet connections adapted to receive hydraulic fluid from a source, such as a pump delivering hydraulic fluid at a higher, primary pressure, a pair of outlet connections adapted to return hydraulic fluid to a reservoir, a pair of load connections, and a pair of pilot connections adapted to receive hydraulic fluid from a source, such as a pump delivering hydraulic fluid at a lower, pilot pressure. The directional valve may be connected, via its load connections, to a work cylinder or other load. Differential pressures in the pilot connections control the directional valve so as to allow hydraulic fluid to flow from one of the inlet connections, through the directional valve, and into one of the load connections and to return from the other load connection, through the directional valve, into one of the outlet connections, whereby the load is driven in one direction, as a function of the direction in which differential pressures are applied.

In accordance with this invention, the pilot valve comprises a body having a chamber, which has an outlet connection adapted to return hydraulic fluid to a reservoir. A common reservoir may be used for the directional valve and for the pilot valve. A pair of nozzles, which are separated from each other, are mounted within the chamber. Each nozzle is connected to one of the pilot connections of the directional valve. The pilot valve further comprises a rocker arm, which is mounted within the chamber for pivotal rotation about a pivot point approximating its midpoint. The rocker arm is provided with a pair of flapper means, preferably separate flappers attached to the rocker arm, which are separated from each other, and which are spaced equally from the midpoint of the rocker arm. Each of the flapper means is juxtaposed to one of the nozzles so as to restrict the flow of hydraulic fluid from that nozzle. Each flapper means allows hydraulic fluid to flow less freely through the juxtaposed nozzle when the rocker arm is pivoted so as to move the flapper means further toward that nozzle. Each flapper means allows hydraulic fluid to flow more freely through the juxtaposed nozzle when the rocker arm is pivoted oppositely. The pilot valve further comprises motor means arranged to impart a torque to the rocker arm so as to move a selected one of the flapper means farther toward the juxtaposed nozzle and to move the other flapper means farther away from the other nozzle, whereby differential pressures can be thus produced in the pilot connections of the directional valve. Moreover, the pilot valve comprises a pair of transducers, each having a cavity connected to one of the return connections of the directional valve. Each transducer has a plug fitted loosely into the cavity. The plug is disposed so as to sense the pressure of hydraulic fluid flowing from the associated return connection of the directional valve into the cavity of the transducer. The plug is coupled to the rocker arm so as to impart a torque to the rocker arm, effectively at a point spaced from the midpoint of the rocker arm, in response to the sensed pressure and in opposition to the torque imparted by the motor means.

Preferably, the motor means comprises a pair of motors coupled to the rocker arm, each motor being arranged to impart a torque to the rocker arm, whenever such motor is actuated, effectively at a point spaced from the midpoint of the rocker arm.

Preferably, the points of application of torque by the plugs of the transducers and the points of application of torque by the motors are spaced unequally from the midpoint of the rocker arm. Although it is preferable for the points of application of torque by the motors to be spaced farther from the midpoint of the rocker arm, the points of application of torque by the plugs by the transducers may be spaced farther from the midpoint of the rocker arm in an alternative embodiment.

Preferably, each transducer is coupled to the rocker arm by at least one leaf spring and preferably by a pair of such springs. At low pressures, the leaf springs are minimally deflected, whereby the torque imparted by the plug of the transducer is substantially proportionate to the pressure sensed by the transducer. At higher pressures, the leaf springs are further deflected.

Preferably, each nozzle is provided with an integral baffle, which is disposed so as to prevent the nozzle and the flapper means in juxtaposition with the nozzle from being pressed against each other. The baffle may be an annular baffle formed in one piece with the nozzle. If the nozzle is mounted to the body of the pilot valve for threaded adjustment of the nozzle relative to the body, the baffle prevents the nozzle and the flapper means associated with the nozzle from being crushed by being pressed against each other in the event that the nozzle is threaded too far toward the flapper means.

Preferably, flow restrictors are disposed in the inlet and outlet connections, each flow restrictor providing a plurality of serpentine paths for hydraulic fluid flowing through such flow restrictor. Preferably, each flow restrictor comprises a stack of annular plates, each being provided with integral, arcuate, spaced baffles, which are equal in angular width, and which are interdigited so as to provide serpentine paths between the plates for hydraulic fluid flowing radially through the low restrictor. The baffles may be thus arranged in plural groups extending radially through the flow restrictor.

These and other objects, features, and advantages of this invention will be better understood from the following description of a preferred embodiment of this invention, with reference to the accompanying drawings.

BRIEF DESCRIPTION OF THE DRAWINGS

FIG. 2 is a greatly enlarged, fragmentary detail of one of a pair of nozzles included in the valve assembly of FIG. 1, as taken in axial cross-section, a juxtaposed flapper being shown also.

FIG. 3 is an enlarged, sectional view through one of a pair of flow restrictors used in the valve assembly of FIG. 1, as taken along line 3—3 in FIG. 1, in the direction of the arrows.

FIG. 4 is a further enlarged, fragmentary, cross-sectional view of the flow restrictor of FIG. 3, as taken along line 4—4 in FIG. 3, in the direction of the arrows.

FIG. 5 is a fragmentary, elevational view of the flow restrictor of FIG. 3, as taken along line 5—5 in FIG. 3, in the direction of the arrows.

DETAILED DESCRIPTION OF PREFERRED EMBODIMENT

Figure 1:
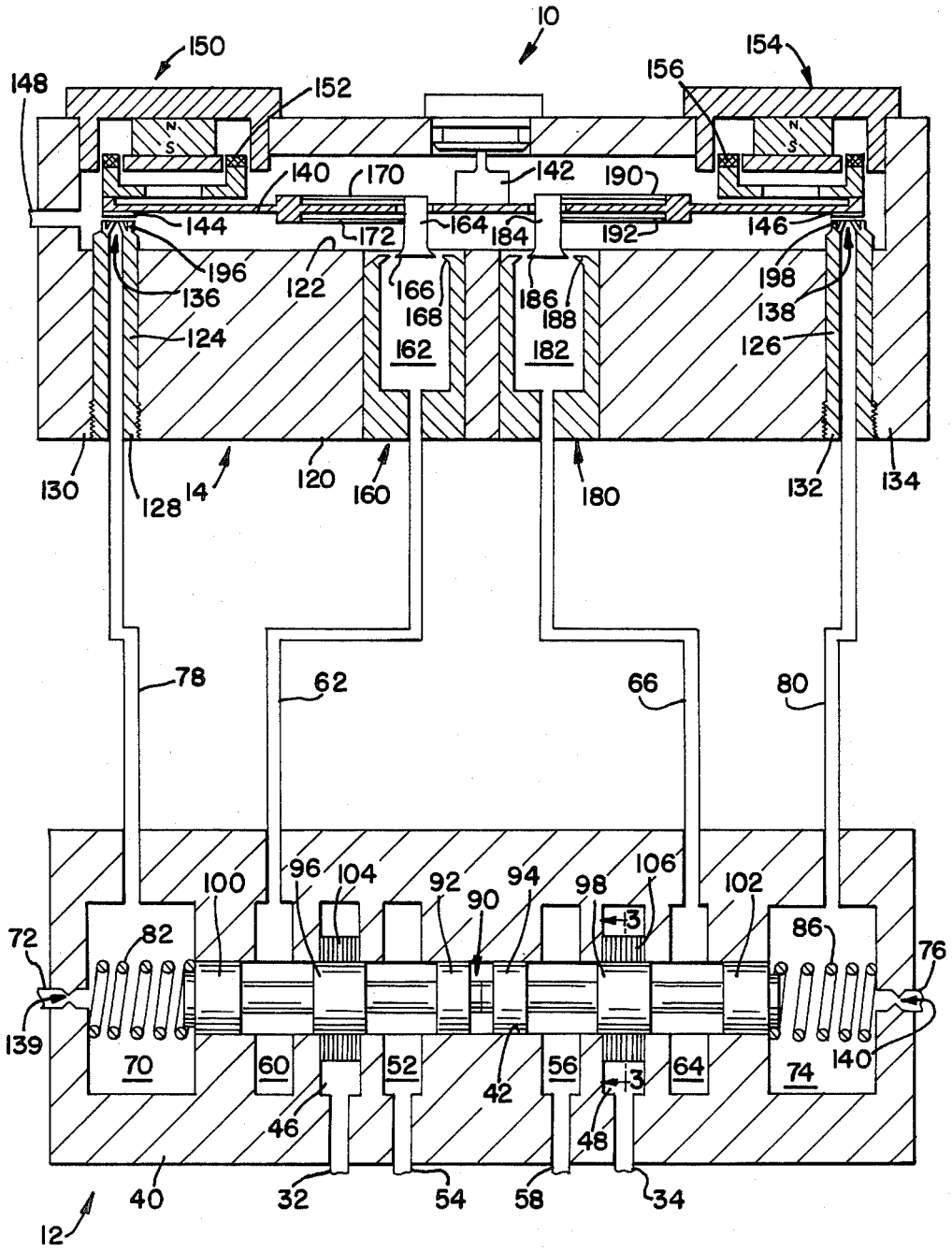
FIG. 1 is a schematic diagram of a valve assembly constituting a preferred embodiment of this invention.
Figure 8:
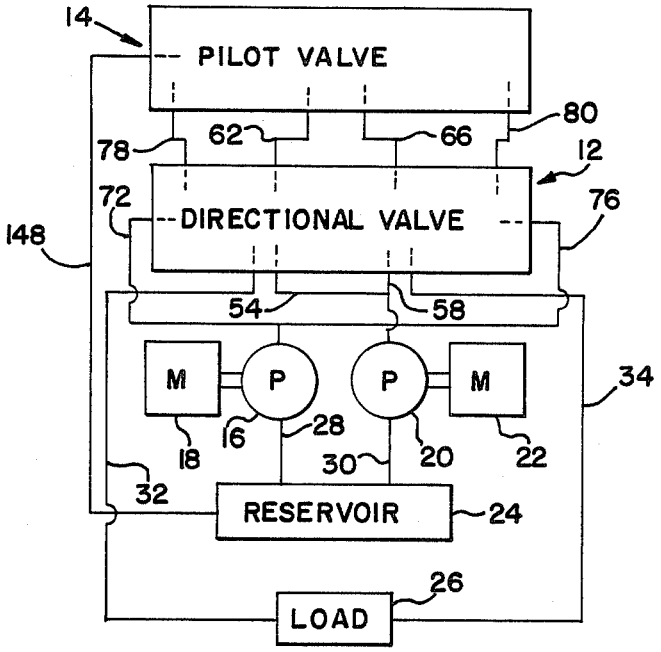
FIG. 8 is a simplified schematic diagram of the valve assembly of FIG. 1, together with associated elements including a pump providing hydraulic fluid at primary pressure, a pump providing hydraulic fluid at pilot pressure, a reservoir, and a load.

As disclosed in FIG. 1 and also in FIG. 8, this invention may be embodied in a valve assembly 10, which comprises a directional valve 12 and a pilot valve 14 of a unique design. The pilot valve 14 controls the directional valve 12. Broadly, in keeping with conventional nomenclature, the directional valve may be described as a four-way, spring-centered, hydraulically positioned, spool valve.

As illustrated in FIG. 8, a pump 16, which is driven by a motor 18, delivers hydraulic fluid at pilot pressure to the directional valve 12. Also, a pump 20, which is driven by a motor 22, delivers hydraulic fluid at primary pressure to the directional valve 12. The pumps 16, 20, draw hydraulic fluid from a common reservoir 24. A single pump (not shown) may replace the pumps 16, 20, in some applications. Typically, primary pressure required is far greater than pilot pressure. Hence, if a single pump is used, pressure-reducing means of a conventional type may be provided between the single pump and those connections where pilot pressure is required. Conventional filters and other conventional components of hydraulic systems may be provided.

As illustrated in FIG. 8, hydraulic lines 32, 34, connect the directional valve 12 to opposite sides of the load 26. The load 26 may be a work cylinder in which a work piston operates or any other load which may be suitably driven by such a valve assembly.

As disclosed in FIG. 1, the directional valve 12 has a valve body 40, in which an elongated cylinder 42 is provided. Various annular chambers are provided around the cylinder 42. Specifically, an annular chamber 46 provided around cylinder 42 is connected to the hydraulic line 32, which provides one of a pair of load connections for the directional valve 12, and an annular chamber 48 provided around the cylinder 42 is connected to the hydraulic line 34, which provides the other load connection for the directional valve 12. Likewise, an annular chamber 52 provided around the cylinder 42 is connected by a hydraulic line 54 to the pump 20 and an annular chamber 56 provided around the cylinder 42 is connected by a hydraulic line 58 to the pump 20. Moreover, an annular chamber 60 provided around the cylinder 42 is connected by a hydraulic line 62 to the pilot valve 14, through which the annular chamber 60 is connected to the reservoir 24 in a manner to be hereinafter described, and an annular chamber 64 provided around the cylinder 42 is connected by a hydraulic line 66 to the pilot valve 14, by which the annular chamber 64 is connected to the reservoir 24 in a manner to be hereinafter described.

A cylindrical chamber 70, which communicates with the cylinder 42 at its left end, serves as one of a pair of pilot connections of the directional valve 12. A hydraulic line 72 connects the cylindrical chamber 70 via a fixed orifice 139 to the pump 16. A cylindrical chamber 74, which communicates with the cylinder 42 at its right end, serves as the other pilot connection of the directional valve 12. A hydraulic line 76 connects the cylindrical chamber 74 via a fixed orifice 140 to the pump 16. A hydraulic line 78 connects the cylindrical chamber 70 to the pilot valve 14 in a manner to be hereinafter described. A hydraulic line 80 connects the cylindrical chamber 74 to the pilot valve 14 in a manner to be hereinafter described. Coiled springs 82, 86, are provided in the cylindrical chambers 70, 74, respectively for purposes to be hereinafter described.

The directional valve 12 also comprises a valve piston 90, which is slidable in the cylinder 42. The valve piston 90 comprises a number of valve spools of uniform diameter. These spools are connected successively by axial rods of smaller diameter permitting hydraulic fluid to flow around such rods. The valve piston 90 comprises a pair of center spools 92, 94, which isolate the right and left halves of the cylinder 42 from each other. The valve piston 90 is made in separate right and left parts, which meet between the center spools 92, 94, and which are pressed against each other by the springs 82, 86 and hydraulic pressures in chambers 70 and 74.

Moreover, the valve piston 90 has a valve spool 96, which is disposed so as to block flow to and from the annular chamber 46 when the valve piston 90 is in its center position, and a valve spool 98, which is disposed so as to block flow to and from the annular chamber 48 when the piston 90 is in its center position. Also, the valve piston 90 has a valve spool 100, which blocks flow of hydraulic fluid between the cylinder 42 and the chamber 70, and a valve spool 102, which blocks flow of hydraulic fluid between the cylinder 42 and the chamber 74. The annular chamber 52 is disposed so as to remain, at any position of the valve piston 90 within the cylinder 42, between the valve spools 92, 96. The annular chamber 56 is disposed so as to remain, similarly, between the valve spools 94 and 98. The annular chamber 60 is disposed so as to remain, similarly, between the valve spools 96, 100. The annular chamber 64 is disposed so as remain, similarly, between the valve spools 98, 102.

When the pressures of hydraulic fluid in the chamber 70, 74 are equal, the springs 82, 86, center the valve piston 70 in its center position, in which hydraulic fluid does not flow through the directional valve 12. Whenever the pressure of hydraulic fluid in the chamber 70 exceeds the pressure of hydraulic fluid in the chamber 74, the valve piston 90 is urged in a right-hand direction, as shown, whereupon, if the pressure differential overcomes the bias exerted by the spring 86 and such inertial and frictional forces as are exhibited by the valve assembly 12, the valve piston 90 is moved in the same direction such that hydraulic fluid under primary pressure is allowed to flow from the annular chamber 56 through a portion of the flow restrictor 106 into the annular chamber 48 and thence to one side of the load 26 via the hydraulic line 34. Thus, hydraulic fluid is allowed to flow from the other side of the load 26 via the hydraulic line 32 to the annular chamber 46, from which hydraulic fluid flows through a portion of the flow restrictor 104 into the annular chamber 60. Hydraulic fluid returns from the annular chamber 60 through the pilot valve 14, via the hydraulic line 62, to the reservoir 24 in a manner to be hereinafter described. Whenever the pressure of hydraulic fluid in the chamber 74 exceeds the pressure of hydraulic fluid in the chamber 70, the valve piston 70 is urged in a left-hand direction, as shown, whereupon, if the pressure differential overcomes the bias exerted by the spring 82 and such inertial and frictional forces as are exhibited by the valve assembly 12, the valve piston 90 is moved in the same direction such that hydraulic fluid is allowed to flow from the annular chamber 52 through the flow restrictor 104 into the annular chamber 46 and thence to the load 26 through the hydraulic line 32. Thus, hydraulic fluid is allowed to flow from the other side of the load 26 via the hydraulic line 34 to the annular chamber 46 and from the annular chamber 46 through the flow restrictor 106 to the annular chamber 64. Hydraulic fluid returns through the pilot valve 14, via the hydraulic line 66, to the reservoir 24 in a manner to be hereinafter described. Generally, except for the flow restrictors 104, 106, which are made in accordance with a unique design, and except for interconnections with the pilot valve 14, the directional valve 12 is similar to known valves of its type.

In accordance with this invention, the pilot valve 14 has a body 120, in which an elongated chamber 122 is provided. A pair of nozzles 124, 126, are mounted so as to extend through the body 120, into the chamber 122, in spaced relation to each other. The nozzle 124 is connected via the hydraulic line 78 to the chamber 70 serving as one of the pilot connections of the directional valve 12. The nozzle 126 is connected via the hydraulic line 80 to the chamber 74 serving as the other pilot connection of the directional valve 12. Each nozzle is mounted to the valve body 120 for threaded adjustment with respect to the valve body 120. Specifically, the nozzle 124 has a threaded end 128, which cooperates with a threaded socket 130 in the valve body 120, and the nozzle 126 has a threaded end 132, which cooperates with the threaded socket 134 in the valve body 120. The nozzle 124 has a small precisely formed orifice, which may be best seen in FIG. 2. The nozzle 126 has a similar orifice 138.

The pilot valve 14 also comprises a rocker arm 140, which is pivotally mounted within the chamber 122 by means of a spring restraint hinge 142, which is made of a resilient material resistant to hydraulic fluid. The hinge 142 provides a pivot point approximating the midpoint of the rocker arm 140.

A flapper 144 is carried by the rocker arm at its left end. The flapper 144 is juxtaposed to the orifice 136 of the nozzle 124 with a small gap remaining between the flapper 144 and the nozzle 124. A flapper 146 is carried by the rocker arm 140 at its right end. The flapper 146 is juxtaposed to the orifice 138 of the nozzle 126 with a similar gap remaining between the flapper 146 and the nozzle 126. Each flapper impedes the flow of hydraulic fluid through the juxtaposed nozzle. Each flapper allows hydraulic fluid to flow less freely through the juxtaposed nozzle when such flapper is moved by the rocker arm further toward the juxtaposed nozzle. Each nozzle allows hydraulic fluid to flow more freely through the juxtaposed nozzle when such flapper is moved by the rocker arm 140 further away from the juxtaposed nozzle. Accordingly, the rocker arm 140 and the flappers 144, 146, may be controllably moved so as to cause differential pressures to be controllably provided in either direction in the chambers 70, 74 of the directional valve 12. When the flapper 144 is moved closer to the nozzle 124, the flapper 146 is moved farther from the nozzle 126, back pressure in the chamber 70 is higher than back pressure in the chamber 74, and vice versa.

The chamber 122 of the pilot valve 14 is connected to the reservoir 24 via a hydraulic line 148 so as to return hydraulic fluid to the reservoir 24.

Moreover, the pilot valve 14 comprises motor means, which includes a pair of permanent magnet field, linear force motors. One such motor 150 is located at the left end of the chamber 122. The armature coil 152 of the force motor 150 is mounted on the rocker arm 140 at its left end. The other motor 154 is located at the right end of the chamber 122. The armature coil 156 of the force motor 154 is mounted on the rocker arm 40 at its right end. Thus, each of the motors 150, 154, is coupled electro-magnetically to the rocker arm 140. When actuated, each of the motors 150, 154, imparts a torque to the rocker arm 140. One of the motors can be actuated while the other motor remains deactuated. Preferably, both motors can be simultaneously actuated but provided with armature currents in opposite directions, the permanent magnet fields of the respective motors being similar, whereupon the torque imparted by the motor means is a net torque. Electrical connections (not shown) are made to the respective coils 152, 156, in a conventional manner. As shown in FIG. 1, if a counterclockwise torque is imparted by the motor means, the flapper 144 is moved closer to the nozzle 124 and the flapper 146 is moved farther from the nozzle 126. If a clockwise torque is imparted by the motor means, the flapper 146 is moved closer to the nozzle 126 and the flapper 144 is moved farther from the nozzle 124. Preferably, neither of the flappers 144, 146 contacts the juxtaposed nozzle. Moreover, the pilot valve 14 comprises a pair of transducers, which serve as feedback devices. Specifically, a transducer 60 has a cavity 162, which is connected to the annular chamber 60 of the directional valve 12 via the hydraulic line 62. As a component of the transducer 160, a plug 164 is fitted loosely in the cavity 162. The plug 164 has a relatively sharp circumferential edge 166 at its lower end. The cavity 162 has a relatively sharp peripheral edge at its upper end. A pair of leaf springs 170, 172, couple the ring 164 mechanically to the rocker arm 140, between the flapper 144 and the pivot hinge 142. Similarly, a transducer 180 has a cavity 182, which is connected to the annular chamber 64 of the directional valve 12 via the hydraulic line 66. As a component of the transducer 180, a plug 184 is fitted loosely in the cavity 182. The plug has a relatively sharp circumferential edge 186 at its lower end. The cavity 172 has a relatively sharp peripheral edge 188 at its upper end. A pair of leaf springs 190, 192, couple the plug 184 mechanically to the rocker arm 140 between the flapper 146 and the pivot hinge 142.

When the directional valve 12 has been operated so as to allow hydraulic fluid to return to the reservoir 24 through the pilot valve 14, the cavity 162 receives hydraulic fluid from the annular chamber 60 of the directional valve 12 via the hydraulic line 62. The plug 164 senses the pressure of hydraulic fluid received by the cavity 162 and imparts a torque to the rocker arm 140 in response to the sensed pressure and in opposition to the torque imparted by the motor means. When the directional valve 12 is operated to as to allow hydraulic fluid to be returned from the annular chamber 64 of the directional valve 12 to the reservoir 26 through the pilot valve 14, the cavity 182 receives hydraulic fluid from the annular chamber 64 via the hydraulic line 66. The plug 184 senses the pressure of hydraulic fluid received by the cavity 182 and imparts a torque to the rocker arm 140 in response to the sensed pressure and in opposition to the torque imparted by the motor means. In either instance, equilibrium is achieved when the torque imparted by the motor means and the torque imparted by whichever of the transducers 160, 180 receives hydraulic fluid in its cavity balance each other. Advantageously, the force imparted by hydraulic fluid to either of the plugs 164, 184, is multiplied, which greatly improves the feedback response wof the pilot valve 14 in contrast with known pilot valves which do not multiply feedback forces (see, for example, U.S. Pat. No. 3,943,957).

Figure 6:
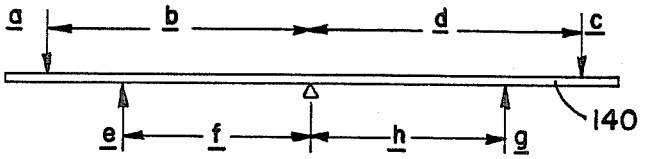
FIG. 6 is a force diagram showing certain torque-producing forces in the preferred embodiment of FIG. 1.

As diagrammed in FIG. 6, which corresponds to FIG. 1, the motor 150 when actuated imparts a torque effectively at a point a, as indicated by an arrow pointing downwardly, at a distance b from the pivot point of the rocker arm 140. Also, the motor 154 when actuated imparts a torque effectively at a point c, as indicated by a arrow pointing downwardly, at a distance d from the pivot point of the rocker arm 140. Additionally, the plug 164 of the transducer 160 when pressure is sensed imparts a torque effectively at a point e, as indicated by an arrow pointing upwardly, at a distance f from the pivot point from the rocker arm 140. Additionally, the plug 184 of the transducer 180 when pressure is sensed imparts a torque effectively at a point g, as indicated by an arrow pointing upwardly, at a distance h from the pivot point of the rocker arm 140. Hence, the pilot valve 14 is arranged so that the mechanical advantage favors the motors 150, 154, over the plugs 164, 184.

Figure 7:
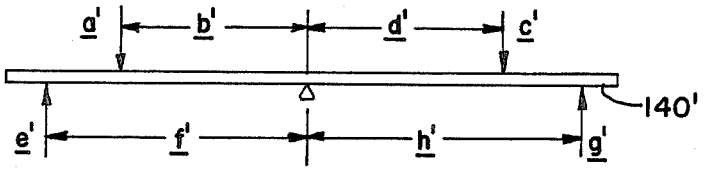
FIG. 7 is a force diagram showing certain torque-producing forces in an alternative embodiment of this invention.

As diagrammed in FIG. 7, which represents an alternative embodiment wherein the pilot valve has a torque arm 140' corresponding generally to the torque arm 140 described above, and in which primed letters indicate analogous points of application of torque and analogus distances from the pivot point of the torque arm, the pilot valve can be so arranged that the mechanical advantage favors the plugs over the motors.

As may be best seen in FIG. 2, the nozzle 124 is provided with an integral, annular baffle 196, which surrounds the nozzle 24 near the orifice 136, and which is disposed to prevent the nozzle 124 at its orifice 136 and the flapper 144 from being pressed against each other. If the nozzle 124 and the flapper 144 were to be somehow pressed against each other, as in an instance when the nozzle 124 was threaded too far into the chamber 122, the nozzle 124 at its orifice 126 could be easily crushed. The nozzle 126 is provided with a similar baffle 198 serving a similar purpose, which is to prevent the nozzle 126 at its orifice 138 and the flapper 146 from being pressed against each other.

As may be best seen in FIGS. 3 through 5, the flow restrictor 106, to which the flow restrictor 104 is similar, comprises a stack of annular plates 202, eight plates being shown as an example not intended as limiting. Each of the plates, except for an end plate **202*a* and an end plate 202*b* are provided on each side with plurality of integral, arcuate, spaced baffles 204, which may be readily formed by conventional machining techniques. Cumbersome etching techniques are not required. The end plate 202*a* and the end plate 202*b* are formed on their inner faces but not on their outer faces with such baffles 204**.

The baffles 204 are interdigited so as to provide serpentine paths for hydraulic fluid flowing radially through the flow restrictor 106. The baffles 204 are equal in angular width so as to provide uniform flow in either direction, i.e. radially inwardly or radially outwardly. The baffles 204 are arranged in plural groups, six groups being shown as an examwple not intended as limiting, which extend radially through the flow restrictor 104.

The flow restrictors 104, 106, reduce the pressure of hydraulic fluid flowing therethrough in a gradual manner, which minimizes or eliminates cavitation and exhibits a desirably low level of noise. Although the flow restrictors 104, 106, are described above for use with hydraulic fluid, which is regarded essentially as an incompressible liquid, such flow restrictors promise to be also useful with compressible fluids, such as air or steam.

It is intended by the following claims to cover all modifications and improvements coming within the true spirit and scope of this invention.

I claim:

1. In a hydraulic valve assembly comprising a directional valve and a pilot valve controlling the directional valve, wherein the directional valve has a pair of inlet connections adapted to receive hydraulic fluid from a source, a pair of outlet connections adapted to return hydraulic fluid to a reservoir, a pair od load connections, and a pair of pilot connections adapted to receive hydraulic fluid from the pilot valve, differential pressures in the pilot connections controlling the directional valve so as to allow hydraulic fluid to flow from one of the inlet connections, through the directional valve, and into one of the load connections and to return from the other of the load connections, through the directional valve, and into one of the outlet connections, an improvement wherein the pilot valve comprises a body having a chamber, the chamber having an outlet connection adapted to return hydraulic fluid to a reservoir, a pair of nozzles separated from each other and mounted within the chamber, each nozzle being connected to one of the pilot connections of the directional valve, a rocker arm mounted within the chamber for pivotal rotation about a pivot point approximating a midpoint of the rocker arm, the rocker arm being provided with a pair of flapper means separated from each other and spaced equally from the midpoint of the rocker arm, each flapper means being juxtaposed to one of the nozzles so as to restrict the flow of hydraulic fluid from said one of the nozzles, each flapper means allowing hydraulic fluid to flow less freely through said one of the nozzles when the rocker arm is pivoted so as to move such flapper means further toward said one of the nozzles, each flapper means allowing hydraulic fluid to flow more freely through said one of the nozzles when the rocker arm is pivoted oppositely, motor means arranged to impart a torque to the rocker arm so as to move a selected one of the flapper means further toward the juxtaposed one of the nozzles and to move the other one of the flapper means further away from the other one of the nozzles, whereby differential pressures can be thus produced in the pilot connections of the directional valve, the pilot valve further comprising a pair of transducers, each transducer having a cavity connected to one of the return connections of the differential valve, each transducer having a plug fitted loosely into the cavity, disposed so as to sense the pressure of hydraulic fluid flowing from said one of the return connections into the cavity of such transducer, and coupled to the rocker arm so as to impart a torque to the rocker arm, effectively at a point spaced from the midpoint of the rocker arm, in response to the pressure sensed by the plug of such transducer and in opposition to the torque imparted by the motor means.

2. The improvement of claim 1 wherein the motor means comprises a pair of motors coupled to the rocker arm, each motor being arranged to impart a torque to the rocker arm, whenever such motor is actuated, effectively at a point spaced from the midpoint of the rocker arm.

3. The improvement of claim 2 wherein the points of application of torque by the plugs of the transducers and the points of application of torque by the motors are spaced unequally from the midpoint of the rocker arm.

4. The improvement of claim 3 wherein the points of application of torque by the motors are spaced farther from the midpoint of the rocker arm.

5. The improvement of claim 3 wherein the points of application of torque by the plugs of the transducers are spaced farther from the midpoint of the rocker arm.

6. The improvement of claim 1 wherein the plug of each transducer is coupled to the rocker arm by at least one leaf spring.

7. The improvement of claim 1 wherein the plug of each transducer is coupled to the rocker arm by a pair of leaf springs.

8. The improvement of claim 1 wherein the directional valve comprises flow restrictors disposed in the inlet and outlet connections, each restrictor providing a plurality of serpentine paths for hydraulic fluid flowing through such restrictor.

9. The improvement of claim 8 wherein each flow restrictor comprises a stack of annular plates, said plates being provided with integral, arcuate, spaced baffles, which are equal in angular width, and which are interdigited so as to provide serpentine paths between the plates for hydraulic fluid flowing radially through the flow restrictor, the baffles being arranged in plural groups extending radially through the flow restrictor.

10. The improvement of claim 1 wherein the directional valve further comprises a buffer integral with each nozzle and disposed to prevent such nozzle and the flapper means juxtaposed to such nozzle from being pressed against each other.

11. The improvement of claim 10 wherein the buffer is annular and surrounds the nozzle.

12. The valve structure of claim 11 wherein the nozzle and the buffer are made in one piece.

* * * * *